US011255222B2

(12) United States Patent
Koukal

(10) Patent No.: US 11,255,222 B2
(45) Date of Patent: Feb. 22, 2022

(54) GUIDE BLADE CARRIER, TURBINE CASING AND TURBINE

(71) Applicant: Siemens Energy Global GmbH & Co. KG, Munich (DE)

(72) Inventor: Jiri Koukal, Brno (CZ)

(73) Assignee: Siemens Energy Global GmbH & Co. KG, Munich (DE)

( * ) Notice: Subject to any disclaimer, the term of this patent is extended or adjusted under 35 U.S.C. 154(b) by 406 days.

(21) Appl. No.: 16/334,591

(22) PCT Filed: Jul. 12, 2017

(86) PCT No.: PCT/EP2017/067486
§ 371 (c)(1),
(2) Date: Mar. 19, 2019

(87) PCT Pub. No.: WO2018/059764
PCT Pub. Date: Apr. 5, 2018

(65) Prior Publication Data

US 2021/0277803 A1 Sep. 9, 2021

(30) Foreign Application Priority Data

Sep. 27, 2016 (EP) ..... 16190872

(51) Int. Cl.
*F01D 25/24* (2006.01)
*F01D 9/04* (2006.01)

(52) U.S. Cl.
CPC ..... *F01D 25/246* (2013.01); *F01D 9/041* (2013.01); *F05D 2240/14* (2013.01); *F05D 2260/30* (2013.01)

(58) Field of Classification Search
CPC .... F01D 25/246; F01D 9/041; F05D 2260/30; F05D 2240/14
See application file for complete search history.

(56) References Cited

U.S. PATENT DOCUMENTS 2,556,890 A * 6/1951 Thorn ..... F01D 25/246 415/136
4,650,396 A 3/1987 Schwarz
(Continued)

FOREIGN PATENT DOCUMENTS

EP 2392784 A1 12/2011
GB 219023 A 10/1925
(Continued)

OTHER PUBLICATIONS

PCT International Search Report and Written Opinion of International Authority dated Nov. 14, 2017 corresponding to PCT International Application No. PCT/EP2017/067486 filed Jul. 12, 2017.

*Primary Examiner* — Woody A Lee, Jr.
*Assistant Examiner* — Brian Christopher Delrue

(57) ABSTRACT

A guide blade carrier for a turbine, the guide blade carrier separating an upstream volume from a downstream volume within the turbine, the guide blade carrier further including a carrier body with a fixation device for fixing of the guide blade carrier within a turbine casing of the turbine. The fixation device has a circumferential fixation basis, wherein the fixation basis is confined at its upstream end by a circumferential limitation element. A turbine casing for a turbine and a turbine, the turbine having a turbine casing and a guide blade carrier.

10 Claims, 3 Drawing Sheets

(56) References Cited

U.S. PATENT DOCUMENTS

| | | | | |
|---|---|---|---|---|
| 6,296,443 | B1 * | 10/2001 | Newman | F01D 9/042 415/189 |
| 6,699,011 | B2 * | 3/2004 | Cot | F01D 9/04 415/173.1 |
| 2015/0082807 | A1 * | 3/2015 | Rauch | F02C 3/045 60/796 |
| 2015/0226075 | A1 | 8/2015 | Aoki et al. | |
| 2016/0090840 | A1 * | 3/2016 | Watkin | F01D 5/02 415/209.3 |
| 2017/0211421 | A1 | 7/2017 | Takamura | |
| 2018/0142572 | A1 * | 5/2018 | Quennehen | F01D 11/08 |

FOREIGN PATENT DOCUMENTS

| | | | |
|---|---|---|---|
| GB | 773430 | A | 4/1957 |
| WO | 2016021330 | A1 | 2/2016 |

* cited by examiner

GUIDE BLADE CARRIER, TURBINE CASING AND TURBINE

CROSS REFERENCE TO RELATED APPLICATIONS

This application is the US National Stage of International Application No. PCT/EP2017/067486 filed Jul. 12, 2017, and claims the benefit thereof. The International Application claims the benefit of European Application No. EP16190872 filed Sep. 27, 2016. All of the applications are incorporated by reference herein in their entirety.

FIELD OF INVENTION

The invention is directed to a guide blade carrier for a turbine, the guide blade carrier separating an upstream volume from a downstream volume within the turbine, the guide blade carrier further comprising a carrier body with a fixation device for fixing of the guide blade carrier within a turbine casing of the turbine, the fixation device comprising an circumferential fixation basis, wherein the fixation basis is confined at its upstream end by an circumferential limitation element. Further the invention is directed to a turbine casing for a turbine and to a turbine, the turbine comprising a turbine casing and a guide blade carrier.

BACKGROUND OF INVENTION

Modern turbines usually comprise two types of blades, namely rotor blades and guide blades. There are often several stages of these blades, usually alternately arranged. Wherein the rotor blades are fastened to the rotor of the turbine and are enabled to carry out a rotational movement, the guide blades are statically fixed to a casing of the turbine. For this fixing purpose, a guide blade carrier is used.

Guide blade carrier of the state of the art are fixed to the turbine casing using a groove and tongue connection arranged circumferential at the guide blade carrier and the turbine casing respectively. This particular type of connection provides a secure fastening of the guide blade carrier within the turbine casing. But on the downside, such a groove and tongue connection often requires a high material usage and is therefore heavy. In addition in most cases it is time consuming and causes high manufacture costs.

SUMMARY OF INVENTION

Therefore, it is an objective of the present invention to provide an improved guide blade carrier, a turbine casing and a turbine which do not have the afore-mentioned drawbacks of the state of the art. It is especially the object of the present invention to provide a guide blade carrier, a turbine casing and a turbine that have a reduced material usage, is easier to assemble and cheaper in production.

This objective is solved by the patent claims. In particular, this objective is solved by a guide blade carrier, by a turbine casing and by a turbine. The dependent claims describe further embodiments of the invention.

According to a first aspect of the invention, the objective is solved by a guide blade carrier for a turbine, the guide blade carrier separating an upstream volume from a downstream volume within the turbine, the guide blade carrier further comprising a carrier body with a fixation device for fixing of the guide blade carrier within a turbine casing of the turbine, the fixation device comprising an circumferential fixation basis, wherein the fixation basis is confined at its upstream end by an circumferential limitation element. A guide blade carrier according to the invention is characterized in that the fixation basis is confined on its downstream end by at least one spatial detached fixing element.

A guide blade carrier according to the invention provides a fixation of guide blades within a turbine casing of a turbine. The guide blades are arranged and fixed at the carrier body of the guide blade carrier. Combined the guide blade carrier and the guide blades separate the interior of the turbine casing in an upstream volume and a downstream volume, wherein in most of the cases a pressure in the upstream volume is higher than the pressure in the downstream volume. Steam, air, exhaust gas and/or other fluids used to drive the turbine flow in a direction from the upstream volume to the downstream volume.

For a secure fixation of the guide blade carrier within the turbine casing, the guide blade carrier comprises a fixation device. Preferably, the turbine casing, in which the guide blade carrier according to the invention is to be used, comprises an adapted part to act together with the fixation device of the guide blade carrier. The fixation device comprises a circumferential fixation basis. The fixation basis annually surrounds the guide blade carrier and can be manufactured as a recess or a protrusion. By this a fixation of the guide blade carrier along the whole circumference of the guide blade carrier can be provided within the turbine casing. On its upstream end the fixation basis is confined by a likewise circumferential limitation element. Therefore also the limitation element annually surrounds the guide blade carrier, Adapted to the embodiment of the fixation basis the limitation element can be manufactured as a protrusion or a recess. In a summary, the fixation basis and the limitation element at least rudimentary form a half of a groove and tongue connector.

According to the invention the fixation basis is confined on its downstream end by at least one spatial detached fixing element. Similar to the fixation basis and the limitation element the fixing element is arranged at the carrier body. The fixing element can be formed as a recess or as a protrusion in or on the carrier body, respectively. It is advantageous that the fixing element is formed as a recess, if the limitation element is manufactured as a recess, and that the fixing element is formed as a protrusion, if the limitation element is manufactured as a protrusion, respectively. Spatial detached according to the invention implies that the fixing element is at least predominantly surrounded of material of the carrier body not used to form the fixation device. Especially, the fixing element is not an annularly and/or circumferentially arranged element at the carrier body. This allows reducing the material usage during the manufacture of the fixing element. Therefore a guide blade carrier according to the invention can be manufactured in a more time and cost efficient way. Simultaneously, the fixing element provides at least locally the missing second half of the groove and tongue connector, whose other half was mentioned above in respect to the fixation basis and the limitation element. If the fixation device comprises two or more fixing elements the fixing elements advantageously are circumferentially positioned at the carrier body to provide the function of the missing second half of the groove and tongue connector. The fixing element is sufficient together with the fixation basis and the limiting element to provide a secure connection and fixation of the guide blade carrier within the turbine casing. Therefore a guide blade carrier according to the invention can be securely fixed within a turbine casing and simultaneously be manufactured with less weight and in a less material, time and cost consuming way.

Further, a guide blade carrier according to the invention can be characterized in that the fixation basis is formed as an annular groove, that the limitation element is formed as an annular disc which forms a rim of the groove, and that the fixing element is formed as an elevated element protruding, in particular radially protruding, from the carrier body. In this embodiment of a guide blade carrier the fixation device forms the groove part of the above mentioned groove and tongue connection. Preferably, the tongue part is formed in the turbine casing. To match the limitation element, the fixing element is protruding from the carrier body. Especially the fixing element can radially protrude from the surrounding surface of the carrier body to simplify an assembly of the guide blade carrier according to the invention into a turbine casing.

In an alternative embodiment a guide blade carrier according to the invention it can be characterized in that the fixation basis is formed as an annular disc which protrudes from the carrier body at least partly, that the limitation element is formed as an annular groove which is at least partly formed by a rim of the disc, and that the fixing element is formed as a recessed element separated, in particular radially separated, in the carrier body. In this embodiment of a guide blade carrier the fixation device forms the tongue part of the above mentioned groove and tongue connection. Preferably, the groove part is formed in the turbine casing. To match the limitation element, the fixing element is formed as a recess in the carrier body. Especially the fixing element can be radially spared in the surrounding surface of the carrier body to simplify an assembly of the guide blade carrier according to the invention into a turbine casing.

Preferably, a guide blade carrier according to the invention can be characterized in that the fixation device comprises at least three, advantageously four, fixing elements. A fixation device comprising one fixing element can at least provide an axial fixation of the guide blade carrier within the turbine casing. With three or advantageously four fixing elements, an additional radial and/or rotational fixing of the guide blade carrier within the turbine casing can provided especial easily. Preferably, the fixing elements are circumferentially positioned at the carrier body. Especially advantageous the fixing elements are symmetrically positioned around the carrier body, advantageously following a radial symmetry. By this an especially secure fixing of a guide blade carrier according to the invention can be provided.

Further, a guide blade carrier according to the invention can be characterized in that the number of the fixing elements is adapted to a size of the guide blade carrier. Especially, a large guide blade carrier, designed for a big turbine casing, can be provided with more fixing elements, especially more than four fixing elements. The free space between the fixing elements can thereby be reduced and the stress on each fixing element during an operation of the turbine can be limited. A long-live cycle of a guide blade carrier according to the invention can therefore be increased.

In another embodiment of a guide blade carrier according to the invention can be characterized in that the carrier body is split into an upper part and a lower part separated by a split plane, wherein the upper part and the lower part advantageously are identically or at least almost identically formed. In most of the cases the internal volume of a turbine casing is rotational symmetric or at least almost rotational symmetric. A connection and fixation respectively of a guide blade carrier within the turbine casing using a groove and tongue connection can be very difficult. By splitting the guide blade carrier in two halves, especially in an upper part and a lower part, the assembly of the guide blade carrier within the turbine casing can be significantly simplified. A split plane defines the position at which the upper and the lower part are put together and touch each other respectively. Further, if the upper part and the lower part are identically or at least almost identically formed, the manufacture of the respective part can also be identical or at least almost identical. For example, if the manufacture process includes a casting step, for both parts the same casting mould can be used. Also the manufacture process of the guide blade carrier itself can therefore be significantly simplified.

In a further improved embodiment a guide blade carrier according to the invention can be characterized in that at least one fixing element is located at the split plane of the carrier body and likewise split in two halves, wherein one half of the fixing element is located on the upper part of the carrier body and the other half of the fixing element is located on the lower part of the carrier body. The two halves of the at least one fixing element form a complete fixing element. In other words, this at least one fixing element is composed of two halves, which both cooperate with the according counterpart in the turbine casing. For example, if the fixing element protrudes from the carrier body, both halves of the at least one fixing element project into the same recess in the turbine casing. This arrangement of the at least one fixing element therefore allows an improved fixation of the upper and the lower part of the guide blade carrier on each other. In a further improvement, on both sides of the guide blade carrier, where the split plane crosses the fixation device, a fixing element is located and split into two halves. An even better fixation of the two parts of the guide blade carrier on each other thereby can be provided.

Additionally, a guide blade carrier according to the invention can be characterized in that the limitation element bears a sealing surface to seal the upstream volume against the downstream volume. The guide blade carrier, in cooperation with the guide blades, separates the upstream volume from the downstream volume. As noted above, a pressure in the upstream volume is in most of the cases higher than a pressure in the downstream volume. A sealing surface located at the limitation element can provide a significant improvement of the separation of these different pressures. A loss of pressure caused by fluid flowing through the connection area of the guide blade carrier and the turbine casing can be prohibited. Preferably, the sealing surface is located on a side of the limitation element, which faces the fixation basis. By this, the pressure difference between the upstream volume and the downstream volume presses the sealing surface at the limitation device at the counterpart of the fixation basis formed on the turbine casing and the sealing is improved further.

According to a second aspect of the invention the objective is solved by a turbine casing for a turbine. A turbine casing for a turbine according to the invention is characterized in that the turbine casing is adapted to cooperate with a guide blade carrier according to the first aspect of the invention. All advantages described in detail in respect to a guide blade carrier according the first aspect of the invention can therefore be achieved by a turbine casing according to the second aspect of the invention, which is adapted to cooperate with a guide blade carrier according to the first aspect of the invention. Especially, a turbine casing according to the invention comprises all necessary counterparts to the fixation device comprised by the used guide blade carrier. A secure fixing of the guide blade carrier within the turbine casing according to the invention can therefore be provided.

According to a third aspect of the invention the objective is solved by a turbine, the turbine comprising a turbine casing and a guide blade carrier. A turbine according to the invention is characterized in that the turbine casing is formed according to the second aspect of the invention and the guide blade carrier is formed according to the first aspect of the invention. All advantages described in detail in respect to a turbine casing according to the second aspect of the invention and in respect to a guide blade carrier according the first aspect of the invention can therefore be achieved by a turbine according to the third aspect of the invention, which comprises a turbine casing according to the second aspect of the invention and a guide blade carrier according to the first aspect of the invention.

BRIEF DESCRIPTION OF THE DRAWINGS

The present invention is further described hereinafter with reference to illustrated embodiments shown in the accompanying drawings. Elements with the same function are specified throughout the figures with the same labels. The drawings show in a schematic way.

DETAILED DESCRIPTION OF INVENTION

Figure 1:
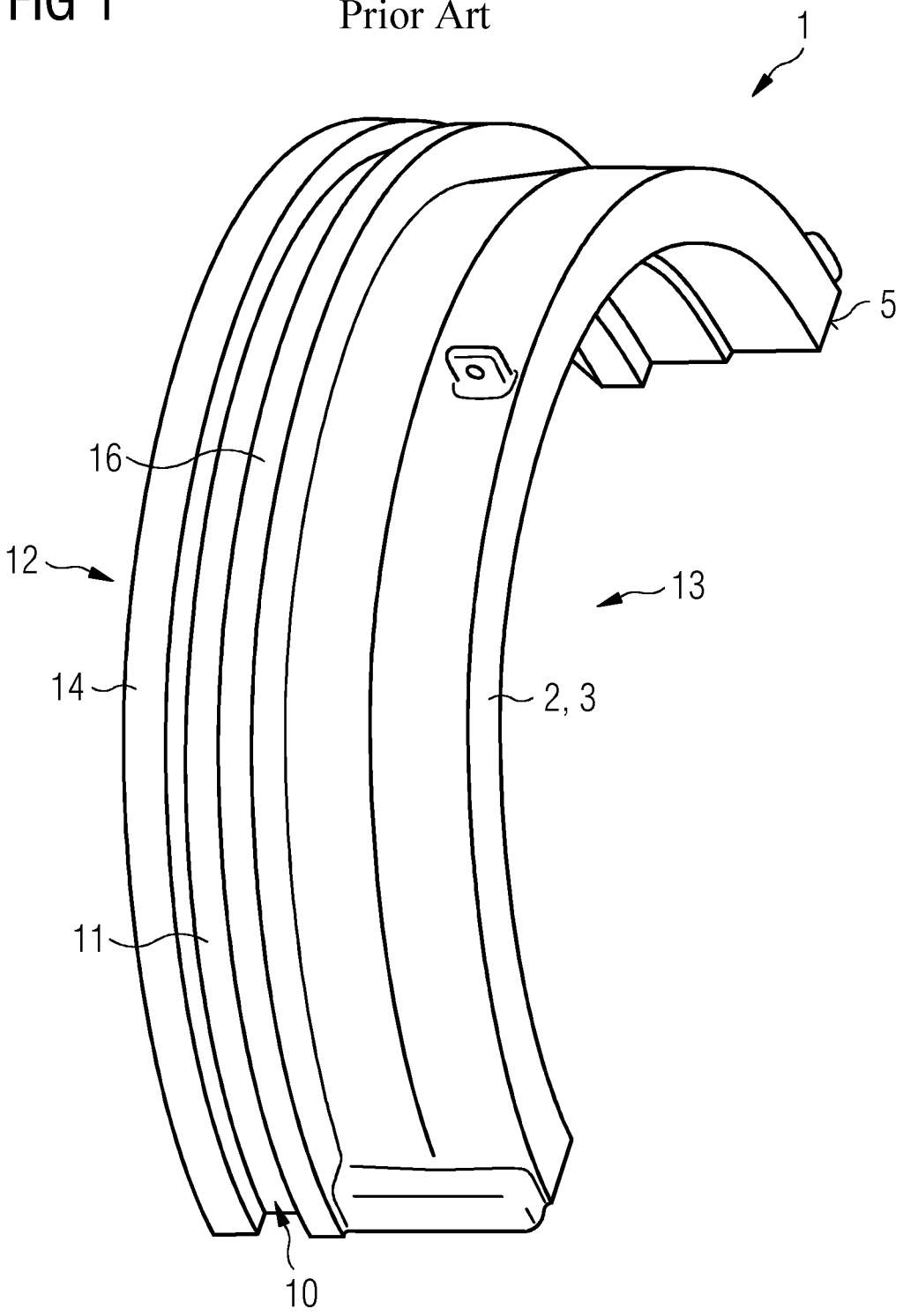
FIG 1 Prior Art
FIG. 1 a part of a guide blade carrier according to the state of the art.

FIG. 1 shows an upper part 3 of a guide blade carrier 1 according to the state of the art. The guide blade carrier 1 and especially the carrier body 2 are split in two parts at a split plane 5. In a mounted state within a turbine 30 (not shown), the guide blade carrier 1 separates an upstream volume 32 and a downstream volume 33 (each not shown). The upstream end 12 of the guide blade carrier 1 faces the upstream volume 32 and the downstream end 13 faces the downstream volume 33. For a fixation of the guide blade carrier 1 within the turbine 30 a fixation device 10 is provided. The fixation device 10 of this guide blade carrier 1 according to the state of the art is designed as a groove and tongue connector, which counterpart is formed in a turbine casing 31 (not shown). The fixation device 10 comprises a fixation basis 11, which is formed as a circumferential groove, a limitation element 14, which is positioned at the upstream end 12 of the carrier body 2, and a second downstream limitation element 16, which is located at the downstream end 13 of the carrier body 2. Both limitation elements 14, 16 are circumferential formed at the carrier body 2. A guide blade carrier 1 according to the state of the art is, especially due to the massive design of the fixation device 10, heavy and comprises a high material, time and cost usage during the manufacturing process.

Figure 2:
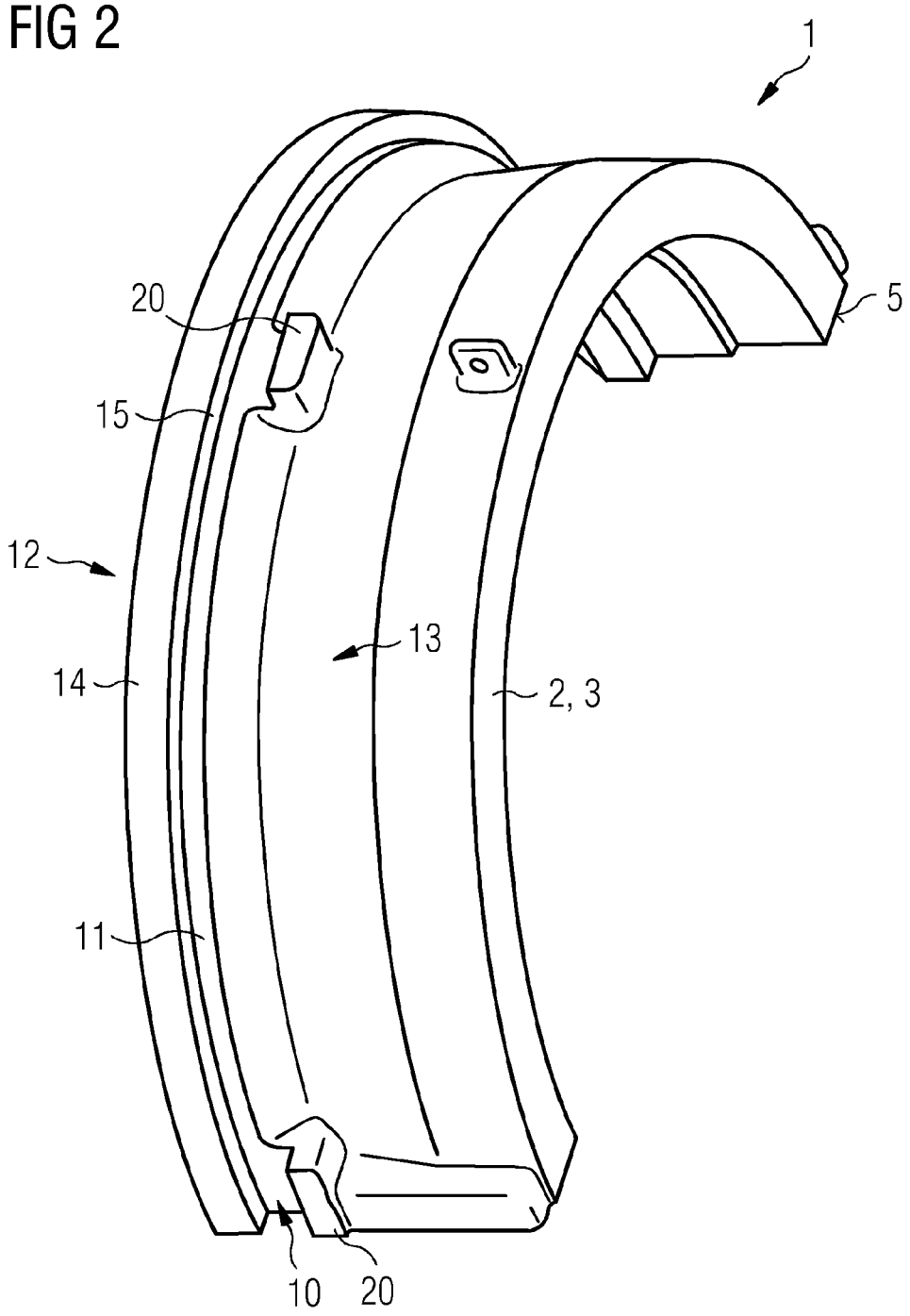
FIG. 2 a part of a guide blade carrier according to the state of the art, and FIG. 3 a part of a turbine according to the invention.

In FIG. 2 a guide blade carrier 1 according to the invention is shown. Some of the design elements of the shown embodiment of a guide blade carrier 1 according to the invention are similar to the embodiment according to the state of the art shown in FIG. 1. The guide blade carrier 1 also is split in two at a split plane 5. Therefore only the carrier body 2 of upper part 3 is depicted. Further, the guide blade carrier 1 according to the invention comprises a fixation device 10, which also is designed as a groove and tongue connector comprising a circumferential fixation basis 11 and a circumferential limitation element 14 arranged at an upstream end 12 of the fixation device 10. In contrast to the embodiment of a guide blade carrier 1 according to the state of the art, the guide blade carrier 1 according to the invention shown in FIG. 2 does not comprise a circumferential downstream limitation device 16 (not shown). On the contrary, the shown embodiment of a guide blade carrier 1 according to the invention comprises fixing elements 20 on the downstream end 13 of the fixation device. The fixing elements 20 are spatially detached arranged at the carrier body 2. Therefore a material usage during the manufacture of the guide blade carrier 1 according to the invention is significantly reduced compared to the manufacture process of a guide blade carrier 1 according to the state of the art. Further, by providing more than one fixing element 20, advantageously three or four, a fixation of the guide blade carrier 1 in a turbine casing 31 can be improved. Especially advantageous a number of used fixing elements 20 can be adapted to a size of the turbine 30, whereby for a larger turbine 30 a guide blade carrier 1 with an increased number of fixing element 20 is provided. In this embodiment, the fixation device 10 is designed as the groove connector of the groove and tongue connection for the fixation in the turbine casing 31 (not shown). Therefore the fixation basis 11 is formed as a groove and the limitation element 14 and the fixing element 20 protrude from a surface of the carrier body 2. In an alternative and not shown embodiment of a guide blade carrier 1 according to the invention the fixation device 10 can form the tongue connector. In this case, the fixation basis 11 protrudes from the carrier body 2 and the limitation element 14 and the fixing element 20 are recesses in the carrier body 2. Further, one of the fixing elements 20 is located at the split plane 5 and, similar to the guide blade carrier 1, split in two halves. Only one half of the fixing element 20 is shown, the other half is located on the lower part 4 (not shown) of the guide blade carrier 1. Each fixing element 20 projects into one single counterpart in the turbine casing 31, even if the fixing element 20 is split in two halves. Therefore, both halves of the split fixing element 20 project into the same counterpart in the turbine casing, providing an additional fixation of the upper part 3 and the lower part 4 of the guide blade carrier 1 on each other. In addition, a sealing surface 15 is provided by the limitation element 14. This sealing surface 15 improves a sealing of the upstream volume 32 against the downstream volume 33 (each not shown) within the turbine. The efficiency of a turbine 30 with such a guide blade carrier 1 can therefore be improved.

Figure 3:
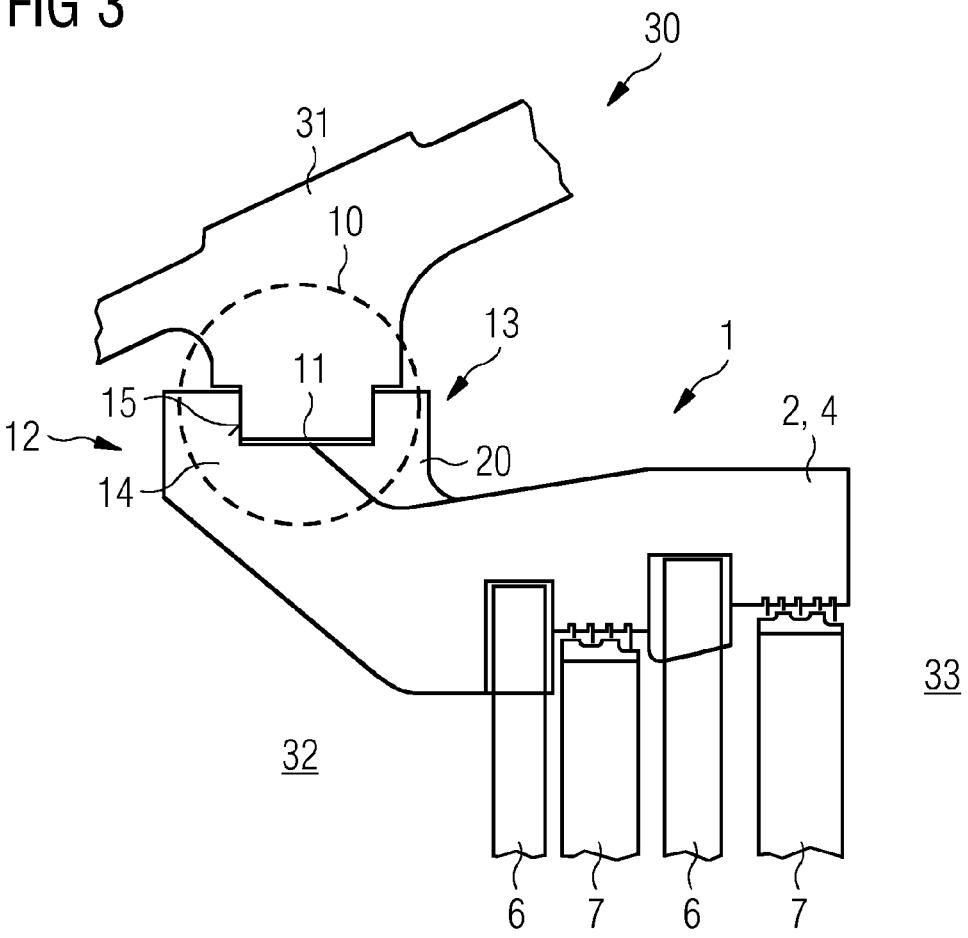

Such a turbine 30 is partly shown in FIG. 3. It is especially depicted the connection part of a turbine casing 31 and a guide blade carrier 1 in a sectional view. On the guide blade carrier 1 guide blades 6 are arranged in a stacked order with rotor blades 7. In this view, a lower part 4 of a carrier body 2 is shown. Also the separation of a volume inside of the turbine 30 in an upstream volume 32 and a downstream volume 33 by the guide blade carrier 1 and the respective guide blades 6 is clearly visible. The guide blade carrier 1 and the turbine casing 31 are connected by a groove and tongue connection. The fixation device 10 of the guide blade carrier 1 comprises a fixation basis 11, formed as a groove. The respective counterpart formed at the turbine casing 31 projects into this groove. The fixation basis 11 is confined at an upstream end 12 by a limitation element 14. Again, this limitation element 14 comprises a sealing surface 15. Due to the fact that the pressure in the upstream volume 32 is in most of the cases higher than the pressure in the downstream volume 33, the sealing surface 15 is pressed against the turbine casing 31. An especially effective sealing can therefore be provided. On the downstream end 13 of the fixation device 10 a fixing element 20 is located. Despite the fact that the fixing element 20 is spatially detached, it is clearly visible in this sectional view that the fixation device as a whole can easily provide the functionality of a groove and tongue connector without the necessity of a circumferential downstream limitation element 16 (not shown). This allows reducing the material usage during the manufacture of the fixation device 10. Therefore a guide blade carrier 1 according to the invention can be manufactured in a more time and cost efficient way.

Aforesaid description of the accompanying drawings is only by the way of detail. Specific features of each aspect of the present invention and of the figures can be combined with each other if of technical sense.

The invention claimed is:

1. A guide blade carrier for a turbine, the guide blade carrier separating an upstream volume from a downstream volume within the turbine, the guide blade carrier comprising:

a carrier body with a fixation device for fixing of the guide blade carrier within a turbine casing of the turbine, wherein the fixation device comprises a circumferential fixation basis, wherein the fixation basis is confined at its upstream end by a circumferential limitation element, and wherein the fixation basis is confined on its downstream end by at least one spatially detached fixing element, wherein the carrier body is split into an upper part and a lower part separated by a split plane, and wherein at least one fixing element is located at the split plane of the carrier body and likewise split in two halves, wherein one half of the fixing element is located on the upper part of the carrier body and the other half of the fixing element is located on the lower part of the carrier body.

2. The guide blade carrier according to claim 1, wherein the fixation basis is formed as an annular groove, wherein the limitation element is formed as an annular disc which forms a rim of the groove, and wherein the fixing element is formed as an elevated element protruding from the carrier body.

3. The guide blade carrier according to claim 2, wherein the fixing element is formed as an elevated element radially protruding from the carrier body.

4. The guide blade carrier according to claim 1, wherein the fixation device comprises at least three fixing elements.

5. The guide blade carrier according to claim 4, wherein the fixation device comprises four fixing elements.

6. The guide blade carrier according to claim 1, wherein the number of the fixing elements is adapted to a size of the guide blade carrier.

7. The guide blade carrier according to claim 1, wherein the limitation element bears a sealing surface to seal the upstream volume against the downstream volume.

8. A turbine casing for a turbine, wherein the turbine casing is adapted to cooperate with a guide blade carrier according to claim 1.

9. A turbine comprising:

a turbine casing and a guide blade carrier, wherein the guide blade carrier is formed according to claim 1, and wherein the turbine casing is adapted to cooperate with the guide blade carrier.

10. The guide blade carrier according to claim 1, wherein the upper part and the lower part are identically formed.

* * * * *